US005990877A

United States Patent [19]

Yeo

[11] Patent Number: 5,990,877

[45] Date of Patent: Nov. 23, 1999

[54] DRIVING CIRCUIT OF AN ACTIVE MATRIX LIQUID CRYSTAL DISPLAY

[75] Inventor: Ju Cheon Yeo, Seoul, Rep. of Korea

[73] Assignee: LG Electronics Inc., Seoul, Rep. of Korea

[21] Appl. No.: 08/791,903

[22] Filed: Jan. 31, 1997

[30] Foreign Application Priority Data

Mar. 4, 1996 [KR] Rep. of Korea ..... 1996-5554

[51] Int. Cl.[6] ..... G09G 5/00

[52] U.S. Cl. ..... 345/204; 345/92

[58] Field of Search ..... 345/204, 92, 90, 345/93, 87–104; 349/42, 48

[56] References Cited

U.S. PATENT DOCUMENTS

| | | | |
|---|---|---|---|
| 4,429,305 | 1/1984 | Hosokawa et al. | 340/784 |
| 4,532,506 | 7/1985 | Kitazima | 340/784 |
| 4,904,989 | 2/1990 | Matsui | 340/719 |
| 5,194,974 | 3/1993 | Hamada | 359/59 |
| 5,412,397 | 5/1995 | Kanatani | 345/99 |
| 5,748,175 | 5/1998 | Shimada | 345/127 |

FOREIGN PATENT DOCUMENTS

| | | |
|---|---|---|
| 5289632 | 5/1993 | Japan . |
| 5143023 | 11/1993 | Japan . |
| 1996-5554 | 3/1996 | Rep. of Korea . |

OTHER PUBLICATIONS

"Display System", MacDonald et al, 1997, p. 178.

*Primary Examiner*—Amare Mengistu
*Assistant Examiner*—Vanel Frenel
*Attorney, Agent, or Firm*—Morgan, Lewis & Bockius LLP

[57] ABSTRACT

A driving circuit of an active matrix liquid crystal display, including a gate driving circuit for applying gate driving signals, the gate driving circuit including a shift register and a buffer; a data driving circuit for applying data driving signals, the data driving circuit including a shift register, a buffer, a visual signal input line, and a plurality of pass gate transistors for outputting visual signals input from the visual signal input line in response to signals input from the buffer, a gate and a source of each pass gate transistor being connected to the buffer and the visual signal input line, respectively; and a data output representing unit connected to the gate driving circuit and the data driving circuit, the data output representing unit including a plurality of data bus lines and scan bus lines crossing each other, the data bus lines and the scan bus lines being connected to the data driving circuit and the gate driving circuit, respectively, a plurality of auxiliary thin film transistors, one of which is respectively connected at each intersection of the data bus lines and scan bus lines, gates and sources of the auxiliary thin film transistors being connected to the data bus lines and the scan bus lines, respectively, and a plurality of pixel thin film transistors, one of which is respectively connected at each intersection, gates and sources of the pixel thin film transistors being connected to drains of the auxiliary thin film transistors and the next data bus lines, respectively.

10 Claims, 4 Drawing Sheets

DRIVING CIRCUIT OF AN ACTIVE MATRIX LIQUID CRYSTAL DISPLAY

BACKGROUND OF THE INVENTION

The present invention relates to an active matrix liquid crystal display, and more particularly to a driving circuit of the point at a time type active matrix liquid crystal display in which charge time of all pixels connected to the end of the gate bus lines is the same so that the quality of a picture is improved.

There, in general, are two driving method of the active matrix LCD(AMLCD) arrangements for driving the LCDs, the line at a time type and the point at a time type. In the line at a time type, a signal voltage is simultaneously applied to pixels connected to one scan bus line and then stored to each pixel while the signal voltage is being applied to one scan bus line. To drive the LCD, therefore, sample and hold circuits which charge the signal voltage corresponding to one scan bus line and then apply to the pixels are needed. In addition, since the distortion of the charged signal voltage must be eliminated, the drive circuit becomes complex. Accordingly, the line at a time type drive circuit is used for an amorphous silicon thin film transistor(a-Si TFT) LCD in which driving integrated circuits(ICs) are attached around the periphery of a liquid crystal panel.

In the point at a time type, the signal voltage is orderly applied to the scan bus lines according to the order of the signal. This type, thus, is employed to poly silicon(p-Si) TFT LCD in which the driving circuit is manufactured on the liquid crystal panel.

FIG. 1 is a view showing the conventional circuit of the point at a time type AMLCD. In this figure, reference numbers 10 and 20 indicate a data driving circuit and a gate driving circuit, respectively.

The data driving circuit 10 comprises a shift register 11 having n output lines, a buffer 12, for outputting the signal input from the shift register 11, having n output and input lines, and pass gate transistors SW1, . . . , SWn to be driven by the signal inputted from the buffer 12. The gates of the pass gate transistors SW1, . . . , SWn are connected to the output lines of the buffer 12, the sources are connected to a visual signal input line 13, and the drains are connected to data bus lines Y1, . . . , Yn of a data output representing unit 30.

The gate driving circuit 20 comprises a shift register 21 having m output lines and a buffer 22, for outputting the signal input from the shift register 21, having m output and input lines. The output lines of the buffer 22 are connected to scan bus lines X1, . . . , Xm of the data output representing unit 30.

The data output representing unit 30 includes an orthogonal array of m horizontal(or, vertical) scan bus lines X1, . . . , Xm and n vertical(or, horizontal) data bus lines Y1, . . . , Yn with a pixel formed at each intersection, where m and n are related to vertical and horizontal resolution of the LCD, respectively.

At the intersection of the scan bus lines X1, . . . , Xm and the data bus lines Y1, . . . , Yn, in the pixels, the TFTs 31 of which the sources are connected to the data bus lines Y1, . . . , Yn. The drains of the TFTs 31 are connected to one electrode of storage capacitors 32, that is, a pixel electrode, and one electrode of an auxiliary storage capacitor 33 in parallel.

The storage capacitor 32 consists of common electrode formed on the upper substrate and the pixel electrode formed on the lower substrate, TFT array substrate, which are facing with liquid crystal. Further, the auxiliary storage capacitor 33 is connected to the storage capacitors 32 in parallel to store charge, so that the flicker caused by the leakage of the TFT is decreased and the variation of the pixel voltage caused by the interference of the signal of the scan bus lines is also decreased.

Since the TFT 31, the storage capacitor 32, and the auxiliary storage capacitor 33 are formed in each pixel, the total number of these is horizontal resolution(m)× vertical resolution(n), respectively.

Accompanying FIG.1 and 2, the operation of driving circuit in the conventional AMLCD is described in detail as follows. In this case, only the pixel connected to the ith scan bus line is described for convenience.

When the horizontal synchronous signal is applied to the gate driving circuit 20, not shown in figures, the gate driving signal Vgi which is applied to the ith scan bus line from the shift register 21 and the buffer 22 of the gate driving circuit 20 is activated. The gate driving signal Vgi is activated for the period that the visual signal Vs is being applied to all pixels Pi1, . . . , Pin formed at the intersection of the ith scan bus line Xi and the data bus lines Y1, . . . , Yn. Thus, the TFTs of pixels Pi1, . . . , Pin connected to the ith scan bus line Xi is turned on for this period.

Subsequently, the visual signal Vs is inputted to the data bus lines Y1, . . . , Yn through the visual signal input line 13, and at the same time the data driving signal Vd1 that is activated through the shift register 11 and the buffer 12 of the data driving circuit 10 for a short period is inputted to the first pass gate transistor SW1, so that the first pass gate transistor SW1 is turned on. For the period that the first pass gate transistor SW1 is turned on, the visual signal Vs is inputted to the storage capacitor 32 and the auxiliary storage capacitor 33 through the first data bus line Y1 and the TFT 31.

When the data driving signal Vd1 applied to the first pass gate transistor SW1 is not activated, the first data bus line Y1 maintains a uniform voltage V11. The first data bus line Y1 maintains this uniform signal, in other words, until the new activated data driving signal Vd1 is applied to the first data bus line Y1 again. Further, the pixel voltage Vp1 of a uniform level, applied from the first data bus line Y1, is kept in the storage capacitor 32 until the next signal has been applied to the pixel.

By de-activating of the first data driving signal Vd1 and activating of the second data driving signal Vd2, the same operation that is carried out in the first data bus line Y1 and the pixel Pi1 is repeated in the second data bus line Y2 and the pixel Pi2.

Repeating this behavior n times, when the gate driving voltage Vgi applied to the ith scan bus line Y1 is not activated and then the next horizontal synchronous signal is applied to the (i+1)th scan bus line X(i+1), the gate driving voltage Vg(i+1) applied to the scan bus line is activated, so that the above behavior is repeated.

While the data driving signal Vdn for driving the pass gate transistor SWn connected to the nth data bus line Yn is activated in the activated state of the gate driving signal Vgi applied to the ith scan bus line Xi, in the aforementioned drive circuit, the visual signal Vs is sufficiently applied to the nth data bus line Yn as the waveform shown in FIG.2. However, because the pixel TFT 31 is smaller than the pass gate transistor, the current driving capacity of the pixel TFT 31 is smaller than that of the pass gate transistor. To store a sufficient signal Vs to the storage capacitor 32, therefore, the signal Vs is continuously stored for a time. In this case, however, the gate of the pixel TFT 31 is turned off before the sufficient signal Vs is not applied to the pixel, so that the signal Vs is partially stored to the storage capacitor 32 and then the signal Vs is distorted.

When the 60 signals is applied to each pixel per 1 second, the activation time of the gate driving signal Vgi is 1/60×1/m(sec) and the activation time of the data driving signal Vdj, where j=1,2, . . . , n, is 1/60×1/m×1/n(sec).

The pass gate transistor SWj is turned on by the data driving signal Vdj to apply the visual signal Vs to the data bus line Yj, and at the same time the visual Vs is delivered to the pixel Pij through the pixel TFT 31. However, because the visual signal Vs of desired magnitude cannot be applied to the pass gate transistor SWj and pixel TFT 31 by the small current delivering capacity of the pass gate transistor SWj and the pixel TFT 31, the data bus line Yj and the pixel Pij require the same charge time for perfect charge. Since the charge time of the pixel, into which the signal is applied through the pixel TFT 31, is longer than that of the data bus line Yj, in addition, the visual signal Vs is continuously charged into the pixel after the disable of the data driving signal Vdj.

The gate driving signal Vgi, for turning on the pixel TFT 31, is kept in an activated state until the last data driving signal Vdn has been de-activated. Accordingly, the visual signal Vs is delivered to each pixel from the data bus line for 1/60×1/m−1/60×1/m×1/n(sec) after non-activation of the data driving signal Vdj applied to the jth data bus line Yj.

In the first pixels connected to each scan bus line, for example, after the data driving signal Vdj is applied to the data bus line Yj and then disabled, there is a remaining time, 1/60×1/m−1/60×1/m×1/n(sec), that the visual signal Vs is delivered to the pixels. In the last pixels Pin, however, the visual signal Vs is applied to the pixels for applying time of the data driving signal Vdj to the data bus line. Therefore, there is a problem that the sufficient signal cannot be applied to the pixels, in which the visual signal is sampled late, and then the quality of a picture is deteriorated.

SUMMARY OF THE INVENTION

It is an object of the present invention to provide a driving circuit of an active matrix liquid crystal display in which the all pixels have sufficient charge time by a auxiliary thin film transistor.

It is an other object of the present invention to provide a driving circuit of an active matrix liquid crystal display in which the quality of a picture and the aperture ratio are improved by the sufficient charge time and a small thin film transistor.

In order to achieve these objects, the present invention comprises a data driving circuit connected to a data bus line to apply a signal to a pixel, a gate driving circuit connected to a scan bus line to turn on the respective pixel TFTs, a data output representing unit for displaying a picture by the visual signal from the data driving circuit.

The data driving circuit includes a shift register having n+1 output lines, a buffer, for outputting the signal input from the shift register, having n+1 input and output lines, pass gate transistors to be driven by the signal input from the buffer, and enable TFTs to be driven by the signal inputted from the buffer and to apply the enable signal voltage to the data bus lines. The gate driving circuit includes a shift register having m output lines and a buffer, for outputting the signal input from the shift register, having m input and output lines. The data output representing unit includes orthogonal array of m horizontal(or, vertical) scan bus lines and n vertical(or, horizontal) data bus lines with a pixel formed at each intersection. At each intersection of the scan bus lines and the data bus lines, an auxiliary TFT of which the gate is connected to the data bus line, the source is connected to the scan bus line, and the drain is connected to the gate of the pixel TFTs are formed. The drain of the pixel TFT is connected to a storage capacitor and an auxiliary storage capacitor in parallel and the source is connected to the data bus line of next column.

DETAILED DESCRIPTION OF THE INVENTION

Figure 1:
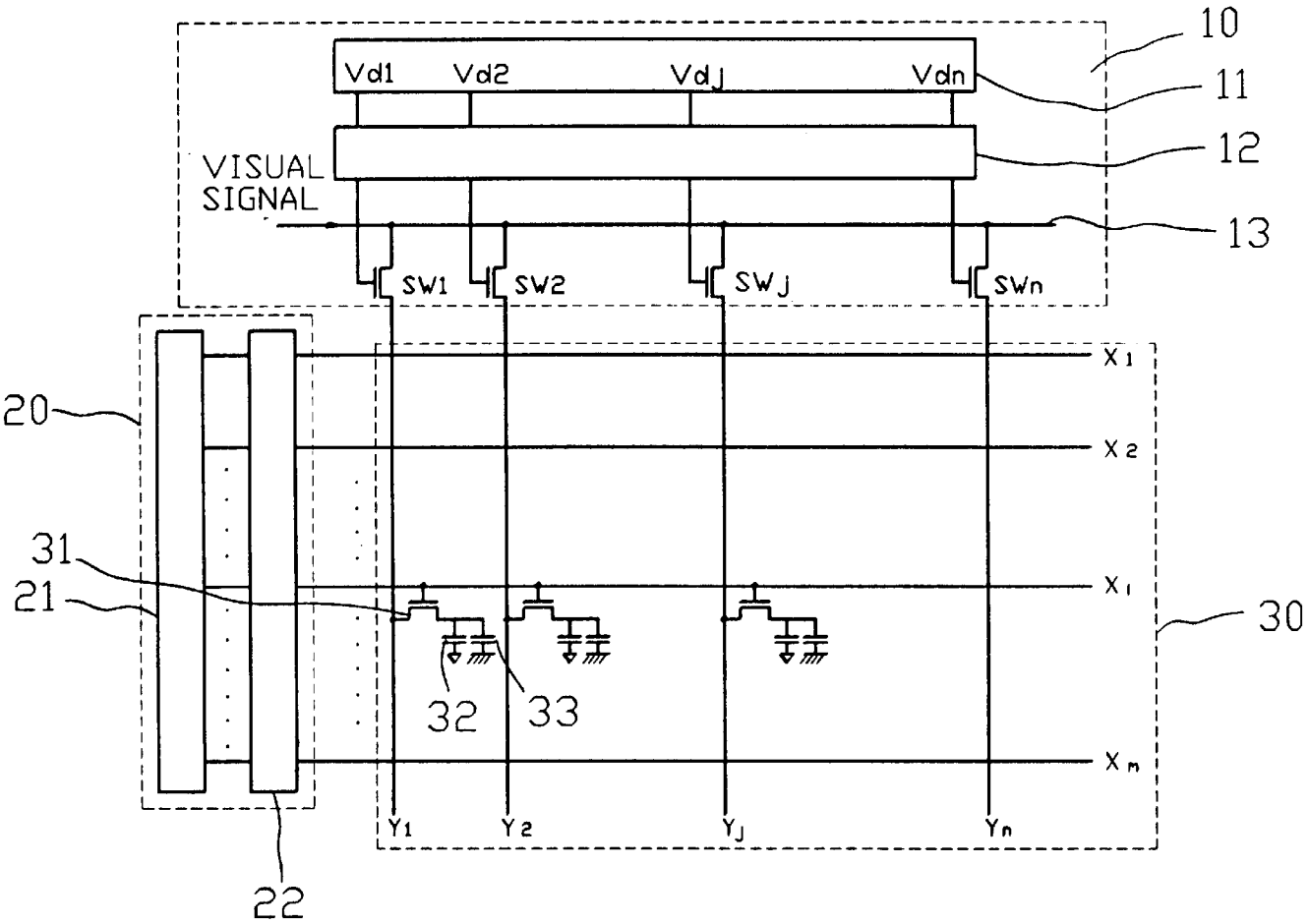
FIG. 1 PRIOR ART
FIG. 1 is a view showing the conventional point at a time type active matrix liquid crystal display.
Figure 2:
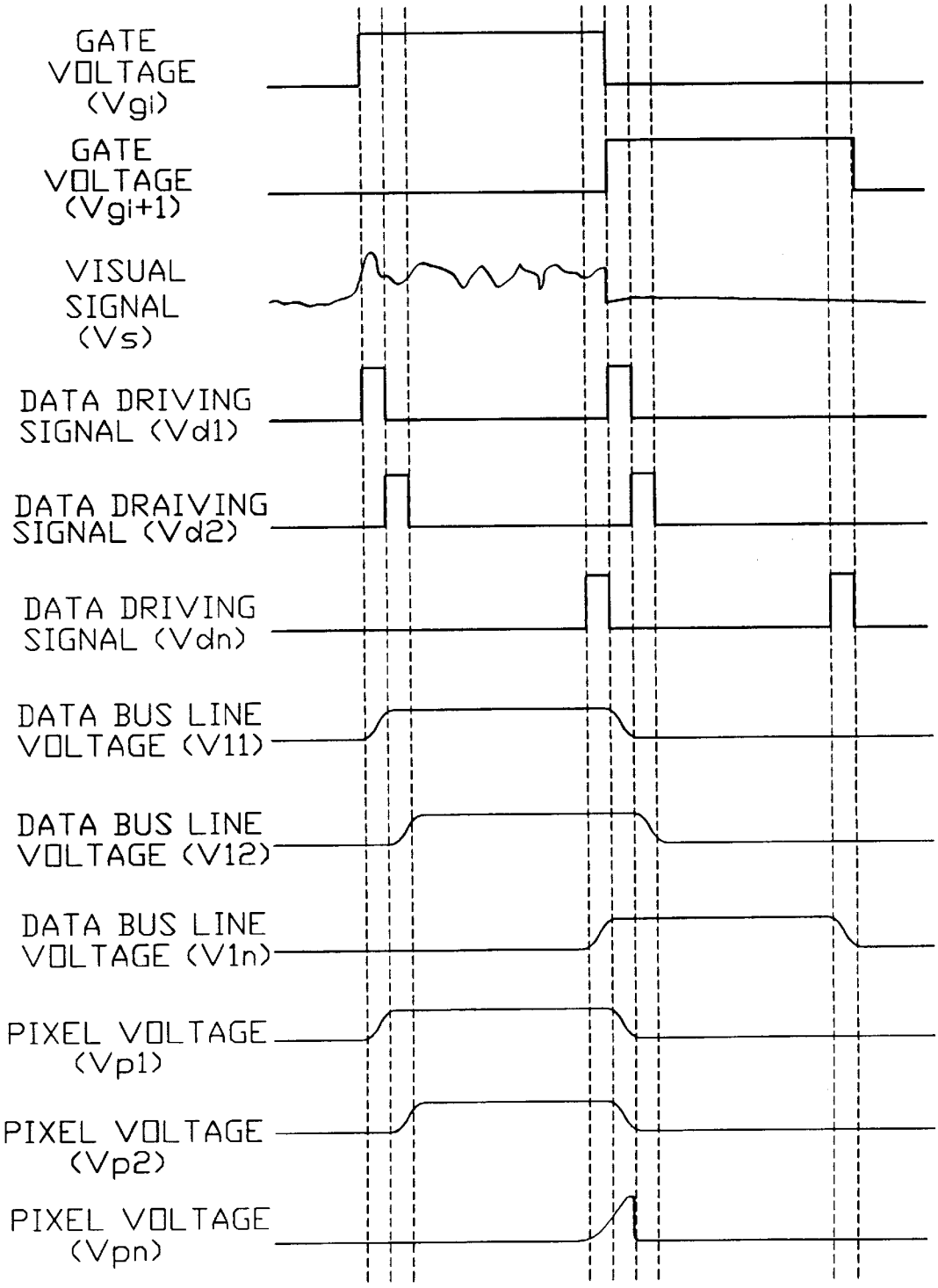
FIG. 2 PRIOR ART
FIG. 2 is a view showing waveforms for driving the conventional point at a time type active matrix liquid crystal display.
Figure 3:
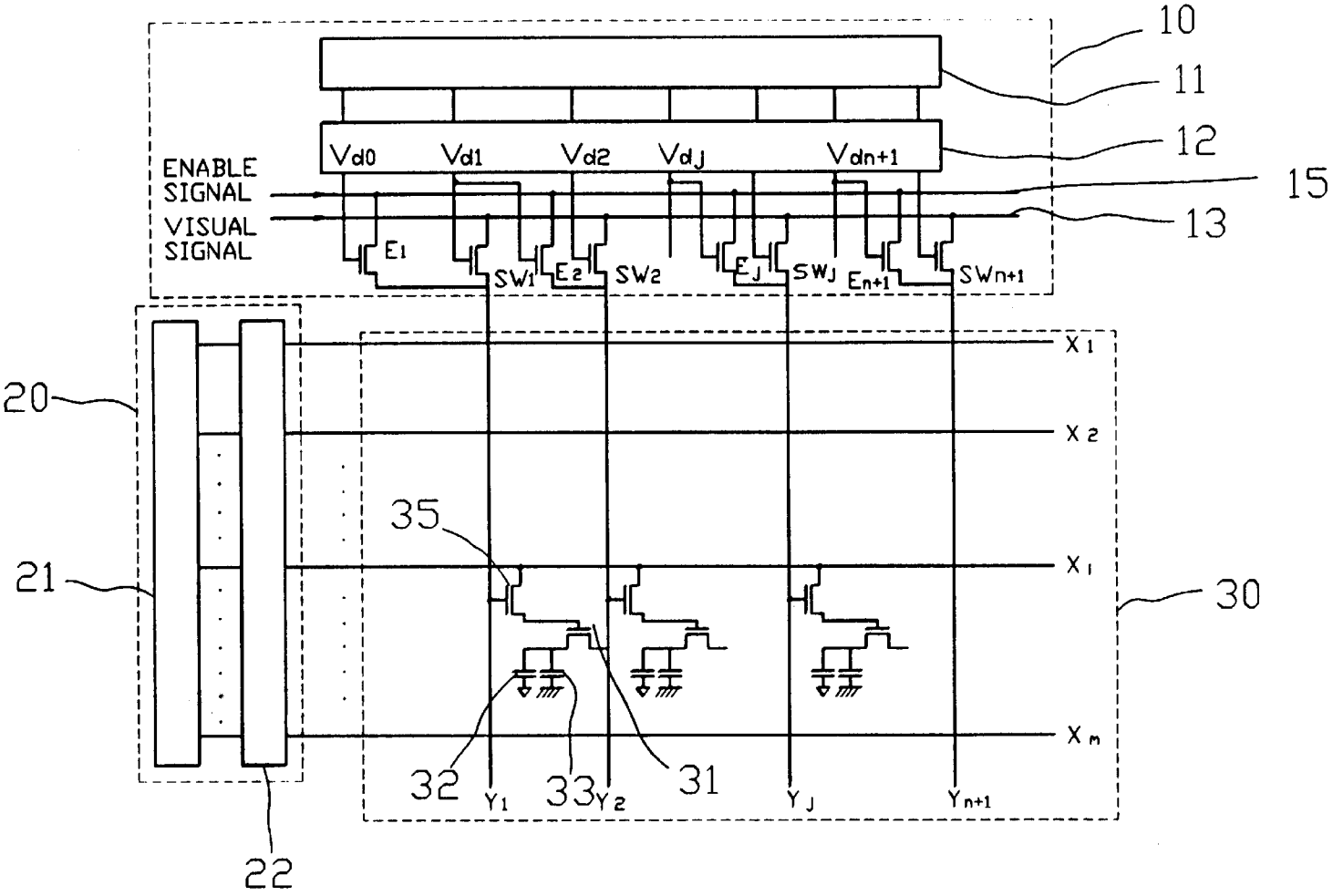
FIG. 3 is a view showing the point at a time type active matrix liquid crystal display according to the present invention.
Figure 4:
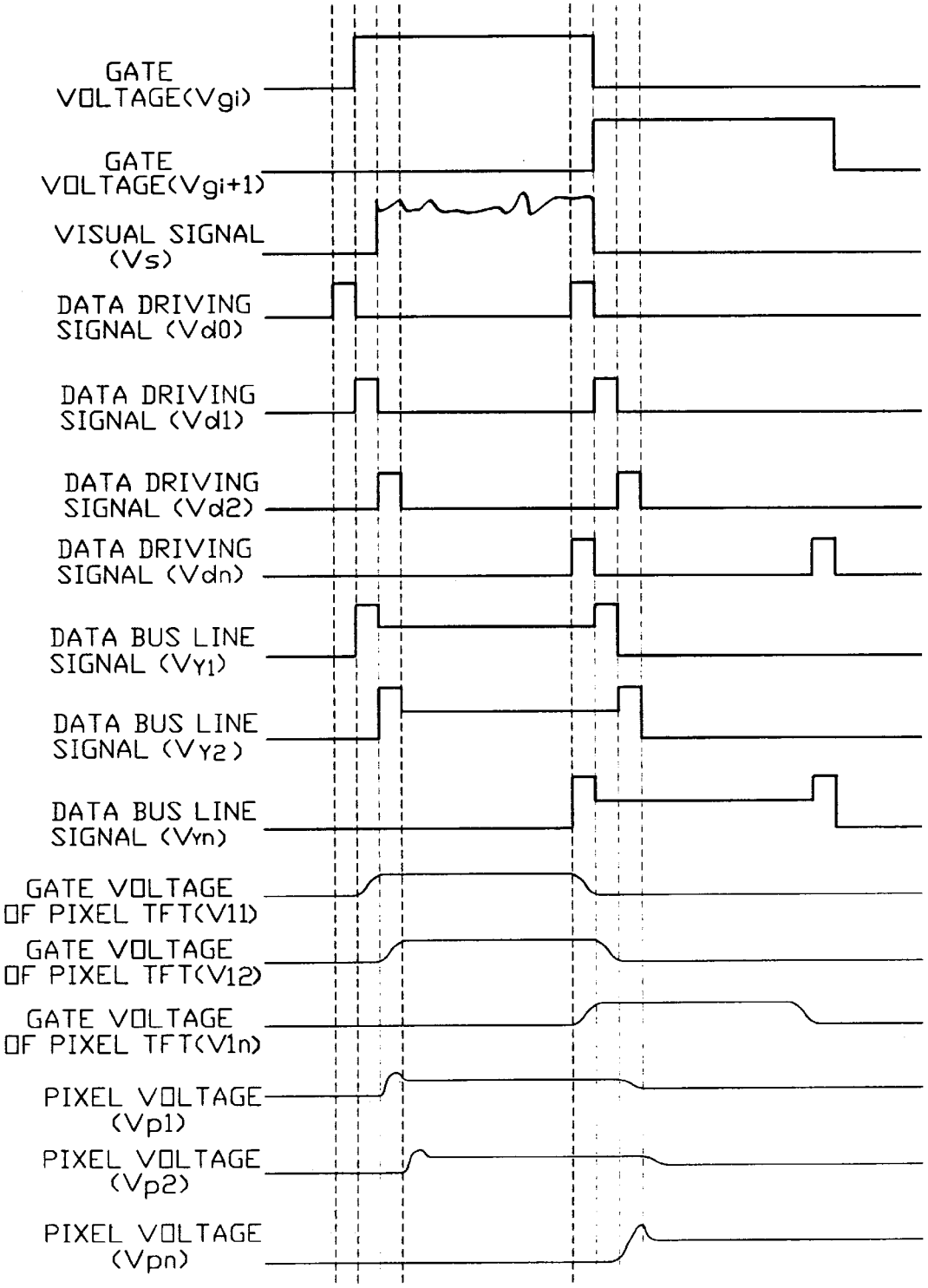
FIG. 4 is a view showing waveforms for driving the present point at a time type active matrix liquid crystal display.

Referring to FIGS. 3 and 4, the data driving circuit 10 comprises the shift register 11 having N+2 output lines and the buffer 12, having N+2 input and output lines, for outputting the signal input from the buffer 12. The pass gate transistors SW1, . . . , SWn+1, of which the gates are connected to the output lines of the buffer 12, are driven by the signal input from the buffer 12 to apply the visual signal Vs to the pixel electrode. The gates of the enable TFTs E1, . . . , En+1, of which the gates are connected to the output lines of the buffer 12, apply the enable signal voltage $V_E$ inputted through an enable signal input line 15 to the data bus lines. The enable signal voltage inputted to the data bus lines through the enable signal input line 15 is approximately 20–30V higher than the threshold voltage of the auxiliary TFTs.

The gate driving circuit 20 comprises the shift register 21 having m output lines and the buffer 22 having m input and output lines so that the signal input from the shift register 21 is applied to the scan bus line. Further, the data output representing unit 30 includes an orthogonal array of m horizontal(or, vertical) scan bus lines X1, . . . , Xm and n vertical(or, horizontal) data bus lines Y1, . . . , Yn+1 with a pixel formed at each intersection. At the intersection of the scan bus lines X1, . . . , Xm and the data bus lines Y1, . . . , Yn, the pixel TFTs 31 and the auxiliary TFTs 35 are formed. The gates, sources, and drains of the auxiliary TFTs 35 are connected to the data bus lines Y1, . . . , Yn, the scan bus lines X1, . . . , Xm, and the gates of the pixel TFTs 31, respectively. The source of the pixel TFT 31 is connected to the data bus line of next column and the drain is connected to the storage capacitor 32 and the auxiliary storage capacitor 33 in parallel.

In the above mentioned drive circuit of the AMLCD, when the horizontal driving signal is applied to the gate driving circuit 20, not shown, the gate driving signal Vgi applied to the ith scan bus line Xi is activated by the shift register 21 and buffer 22. Thereafter, the first enable TFT E1 is turned on by activation of the data driving signal Vd0, so that the enable signal is applied to the first data bus line Y1 from the enable signal input line 15. The gate driving signal Vgi maintains the activation state until the data driving signals Vd0–Vdn have been applied to all the data bus lines Y1, . . . , Yn+1. Simultaneously with the de-activation of the data driving signal Vd0 and thereafter, if the data driving signal Vd1, corresponding to the first data bus line Y1, is activated for short period by the shift register 11 and the buffer 12 of the data driving circuit 10, the visual signal Vs is applied to the first data bus line Y1 through the visual signal input line 13.

When this data driving signal Vd1 is not activated, the first data bus line Y1 keeps uniform voltage until the data driving signal Vd0 to be applied to the first enable TFT E1 has been activated again. Namely, the first data bus line Y1 keeps a uniform signal until the new enable signal has been applied to it by the activation of the new data driving signal Vd0. Since the enable TFT E1 connected to the first data bus line Y1 is turned on just before activation of the visual signal Vs, the first data bus line Y1 maintains its uniform enable signal until the first pass gate transistor SW1 has been turned on. The data driving signal Vd0 is activated for second time during off-state of the first pass gate transistor SW1 and then de-activated at the same time that the first pass gate transistor SW1 is turned on. Accordingly, if the enable signal voltage becomes higher than the visual signal voltage, the data bus line voltage signal Vy1 applied to the first data bus line becomes the pulse of the form that its front and rear part are raised.

When the data bus line voltage signal Vy1 is input to the gate of the auxiliary TFT 35 through the first data bus line Y1, the auxiliary TFT 35 is turned on so that the gate driving signal Vgi is stored to the gate of the pixel TFT 31. Because the voltage applied to the enable signal input line 15 is 20–30V, at this time, if the threshold voltage of the auxiliary TFT 35 becomes higher than that of the pixel TFT 31, about 5–10V, the auxiliary TFT 35 is turned on when the front raised part of the data bus line voltage signal, that is, the enable signal region, is input. Further, this auxiliary TFT 35 is turned off at the middle part of the data bus line voltage signal between the raised front and rear part, and turned on at the rear raised part again. Thus, the gate driving signal Vgi is stored to the gate of the pixel TFT 31 for applying time of the visual signal Vs, so that the pixel TFT 31 maintains in the on-state for that period.

Accordingly, the visual signal Vs is delivered to the storage capacitor 32 and the auxiliary capacitor 33 of the first pixel Pi1 through the pixel TFT 31 and the signal Vp1 of uniform level is charged to the pixel Pi1 while the pixel TFT 31 is turning on, that is, the visual signal Vs is applied.

Subsequently, when the first data driving signal Vd1 is de-activated, the second data driving signal Vd2 is activated so that the same operation as that of the first data bus line Y1 and the pixel Pi1 repeats.

In the nth activation of the data driving signal Vdn, the pixel TFT 31 stores a uniform voltage until the auxiliary TFT 35 has been turned off at the enable signal applying region, after the auxiliary TFT 35 is turned on at the enable signal applying region and then turned off at the visual signal region. Accordingly, in a case where the ith gate driving signal Vgi is not activated and the (i+1)th gate driving signal Vg(i+1) is activated, the pixel TFT 31 maintains in an on-state for uniform period, so that the charge time of the visual signal Vs to the pixel Pin becomes always uniform.

Thereafter, when the gate driving signal Vgi, being applied to the ith scan bus line Xi, is de-activated and then the next horizontal synchronous signal is applied the gate driving circuit 20, this driving signal Vg(i+1) is activated, so that the aforementioned operation repeats.

In present driving circuit of the AMLCD, since the charge time of the visual signal to all pixels becomes uniform, a sufficient visual signal is charged to the pixel connected to the end part of the data bus line to improve the quality of the displayed picture.

While the preferred form of the present invention has been described, it is be understood that modifications will be apparent to those skilled in the art without departing from the spirit of the invention.

The scope of the invention, therefore, is to be determined solely by the following claims.

What is claimed is:

1. A driving circuit of an active matrix liquid crystal display, comprising:

a gate driving circuit for applying gate driving signals, the gate driving circuit including a shift register having a plurality of output lines and a buffer having a plurality of input and output lines;

a data driving circuit for applying data driving signals, the data driving circuit including a shift register having a plurality of output lines, a buffer having a plurality of input and output lines, a visual signal input line, and a plurality of pass gate transistors for outputting visual signals input from the visual signal input line in response to signals input from the buffer, a gate and a source of each pass gate transistor being connected to the buffer and the visual signal input line, respectively; and a data output representing unit connected to the gate driving circuit and the data driving circuit, the data output representing unit including a plurality of data bus lines and scan bus lines crossing each other, the data bus lines and the scan bus lines being connected to the data driving circuit and the gate driving circuit, respectively, a plurality of auxiliary thin film transistors, one of which is respectively connected at each intersection of the data bus lines and scan bus lines, gates and sources of the auxiliary thin film transistors being connected to the data bus lines and the scan bus lines, respectively, and a plurality of pixel thin film transistors, one of which is respectively connected at each intersection, gates and sources of the pixel thin film transistors being connected to drains of the auxiliary thin film transistors and the next data bus lines, respectively.

2. A driving circuit of an active matrix liquid crystal display according to claim 1, further comprising:

an enable signal input line providing an enable signal; and a plurality of enable thin film transistors, each of the enable thin film transistors applying the enable signal to the respective data bus lines, a gate, source, and drain of each enable thin film transistor being connected to a respective output line of the buffer, the enable signal input line, and data bus line, respectively.

3. A driving circuit of an active matrix liquid crystal display according to claim 1, further comprising:

a plurality of storage capacitors, each respectively connected to a respective drain of the pixel thin film transistors; and a plurality of auxiliary storage capacitors, each respectively connected to one of said storage capacitors in parallel.

4. A driving circuit of an active matrix liquid crystal display according to claim 1, wherein the threshold voltage of the auxiliary thin film transistor is higher than that of the pixel thin film transistor.

5. A driving circuit of an active matrix liquid crystal display according to claim 2, wherein a voltage applied to the enable signal input line is approximately 20–30V.

6. A driving circuit of an active matrix liquid crystal display, comprising:

first shift register having a plurality of output lines;

first buffer having a plurality of input and output lines, the first buffer being connected to the first shift register;

second shift register having a plurality of output lines;

second buffer having a plurality of input and output lines, the second buffer being connected to the second shift register;

a visual signal input line having a visual signal being input thereto;

a plurality of pass gate transistors for outputting visual signals input from the visual signal input line in response to signals input from the second buffer, a gate and a source of each pass gate transistor being connected to the second buffer and the visual signal input line, respectively;

a plurality of scan bus lines and data bus lines crossing each other at a plurality of intersections, the scan bus lines being connected to respective outputs of the first buffer and the data bus lines being connected to respective drains of the pass gate transistors;

a plurality of auxiliary thin film transistors, one of which is respectively connected at each intersection of the data bus lines and scan bus lines, gates and sources of the auxiliary thin film transistors being connected to the data bus lines and the scan bus lines, respectively; and a plurality of pixel thin film transistors, one of which is respectively connected at each intersection, gates and sources of the pixel thin film transistors being connected to drains of the auxiliary thin film transistors and the next data bus lines, respectively.

7. A driving circuit of an active matrix liquid crystal display according to claim 6, further comprising:

an enable signal input line providing an enable signal; and a plurality of enable thin film transistors, each of the enable thin film transistors applying the enable signal to the respective data bus lines, a gate, source, and drain of each enable thin film transistor being connected to a respective output line of the buffer, the enable signal input line, and data bus line, respectively.

8. A driving circuit of an active matrix liquid crystal display according to claim 6, further comprising:

a plurality of storage capacitors, each respectively connected to a respective drain of the pixel thin transistors; and a plurality of auxiliary storage capacitors, each respectively connected to one of said storage capacitors in parallel.

9. A driving circuit of an active matrix liquid crystal display according to claim 6, wherein the threshold voltage of the auxiliary thin film transistor is higher than that of the pixel thin film transistor.

10. A driving circuit of an active matrix liquid crystal display according to claim 7, wherein a voltage applied to the enable signal input line is approximately 20–30V.

* * * * *